United States Patent [19]

Harned

[11] 4,013,047

[45] Mar. 22, 1977

[54] ENGINE WITH COMBUSTION WALL TEMPERATURE CONTROL MEANS

[75] Inventor: John L. Harned, Grosse Pointe Woods, Mich.

[73] Assignee: General Motors Corporation, Detroit, Mich.

[22] Filed: Dec. 12, 1975

[21] Appl. No.: 640,027

[52] U.S. Cl. ..... 123/41.2; 123/41.31; 123/41.35; 165/51; 165/105

[51] Int. Cl.[2] ..... F01P 9/02

[58] Field of Search ..... 123/41.2, 41.21, 41.42, 123/41.31, 41.82, 41.35; 165/105, 51

[56] References Cited

UNITED STATES PATENTS

| | | | |
|---|---|---|---|
| 1,258,155 | 3/1918 | Shepherd | 123/30 |
| 1,466,346 | 8/1923 | Shepherd | 123/145 |
| 2,292,946 | 8/1942 | Karig | 123/41.2 |
| 3,448,729 | 6/1969 | Parsons | 123/41.2 |
| 3,670,495 | 6/1972 | Leffert | 165/105 |
| 3,731,660 | 5/1973 | Leffert | 123/41.42 |
| 3,822,680 | 7/1974 | Showalter | 123/41.2 |
| 3,838,668 | 10/1974 | Hays | 165/105 |
| 3,945,353 | 3/1976 | Dreisin | 123/41.31 |
| 3,963,010 | 6/1976 | Harned | 165/105 |

*Primary Examiner*—C. J. Husar
*Assistant Examiner*—Daniel J. O'Connor
*Attorney, Agent, or Firm*—Robert J. Outland

[57] ABSTRACT

An internal combustion engine is provide with heat pipe capsules integrated into portions of the combustion chamber wall-forming components of the engine such as the pistons and cylinder head and arranged to transmit heat from the portions of the combustion chamber walls formed by the capsules to adjacent cooling fluid systems at rates controlled by the heat pipe capsules to maintain a predetermined wall temperature range adequate to promote combustion while avoiding detonation or coking of fuel on the wall surfaces.

8 Claims, 4 Drawing Figures

ENGINE WITH COMBUSTION WALL TEMPERATURE CONTROL MEANS

This invention relates to internal combustion engines and more specifically to arrangements for controlling temperatures of the combustion chamber walls or portions thereof by providing heat pipe capsules formed as integral parts of the combustion chamber wall-forming components.

It is known that conventional construction of internal combustion engines and cooling systems for such engines results during operation in substantial variations in the temperatures of the walls of components such as cylinder heads, pistons and cylinder blocks or liners that define the combustion chambers of an engine. Wall temperatures commonly reach their maximums under heavy load, wide open throttle engine operating conditions when combustion temperatures and heat loads are the greatest. Engine cooling systems must be and are designed to transmit sufficient heat through the component walls forming the combustion chamber to maintain the temperatures of these walls below reasonable maximums during such operating conditions. Such requirements are necessary to avoid problems of detonation and pre-ignition and the possibility of coking of fuel residues on the combustion chamber walls.

As might be expected, when an engine is operated under part throttle or at lower than maximum loads, heat rates are correspondingly reduced, and the cooling provided for maintaining maximum temperatures at maximum heat rates tends to cool the walls of the combustion chambers below the maximum temperature levels to lower temperatures which may adversely affect combustion, permitting quenching in the zones adjacent to the wall surfaces. This is particularly true in areas of close clearance, sometimes referred to as quench zones or crevice volumes, in which it is difficult to maintain combustion of air-fuel mixtures and it is not possible to do so if the wall temperatures are too low. Wall quenching is considered to be a prime cause of exhaust emissions of unburned hydrocarbons.

It is desirable, therefore, to provide means for keeping the wall temperatures of an internal combustion engine, especially those in the close clearance locations of the chamber, at temperatures which are sufficiently high to promote combustion, while still providing adequate cooling to prevent the same wall areas from reaching excessive temperatures under high load conditions.

The present invention takes advantage of the relatively constant temperature heat transfer characteristics which may be obtained from properly designed vapor cooling devices of the type commonly referred to as heat pipes. This invention provides sealed capsules incorporating heat pipe arrangements adapted to the particular locations in which they are utilized and arranged to provide heat transfer at controlled temperature levels between portions of the combustion chamber walls formed by the heat pipe capsules and fluid cooling systems provided to cool the selected components.

In a specific application, the invention provides an engine piston arrangement having the upper portion of the piston designed to incorporate a heat pipe capsule for controlled transfer of heat from the combustion chamber defining wall of the piston to cooling oil sprayed under the bottom of the capsule.

In another application, which may be used in combination with the first, the invention provides a cylinder head having heat pipe capsules formed integrally to define portions of the combustion chamber surfaces and control heat transfer from such surface portions to liquid coolant in adjacent coolant jacket passages and to air-fuel mixture in adjacent induction passages.

These and other applications, features and advantages of the invention will be more fully understood from the following description of a preferred embodiment taken together with the accompanying drawing.

Figure 1:
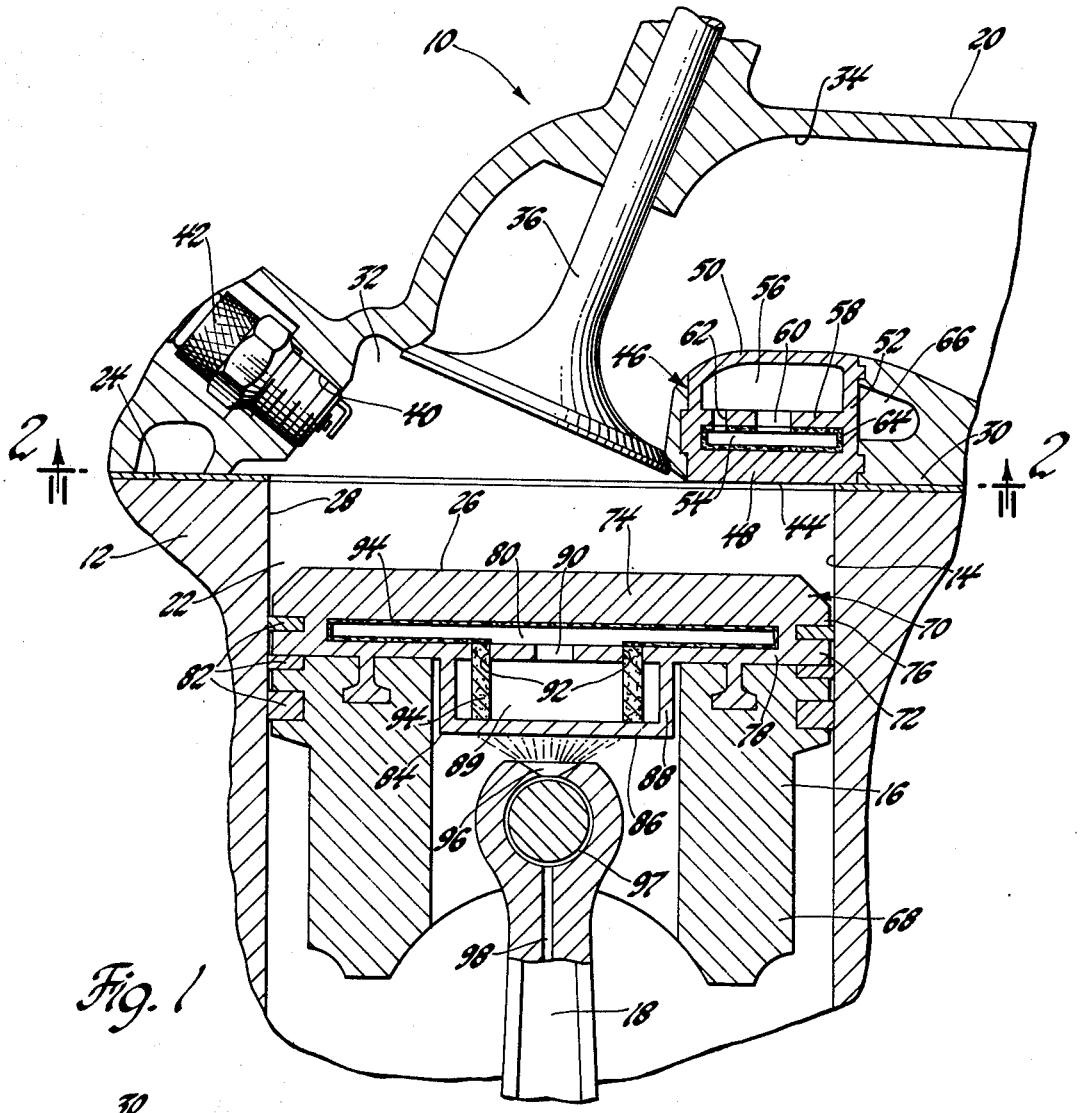
FIG. 1 is a fragmentary cross-sectional view of a portion of one cylinder and the associated head of an internal combustion engine having heat pipe capsule combustion chamber wall temperature control means formed according to the invention.
Figure 2:
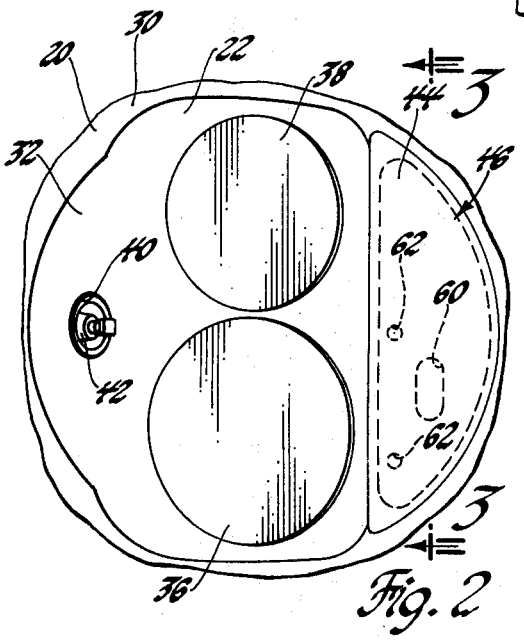
FIG. 2 is a plan view of the combustion chamber wall surfaces of the cylinder head viewed in the direction of the arrows from the plane indicated by the line 2—2 of FIG. 1.
Figure 3:
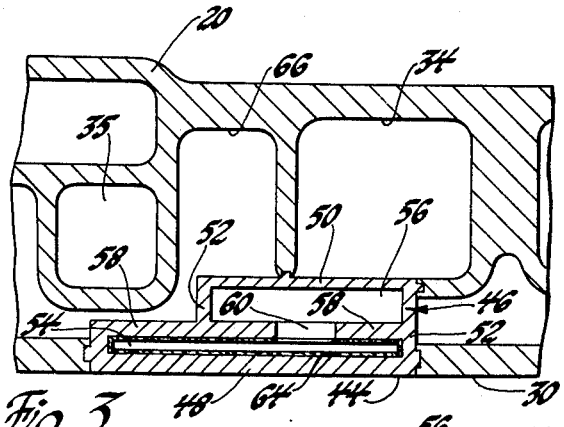
FIG. 3 is a fragmentary cross-sectional view of a portion of the cylinder head as viewed from the plane indicated by the line 3—3 of FIG. 2.
Figure 4:
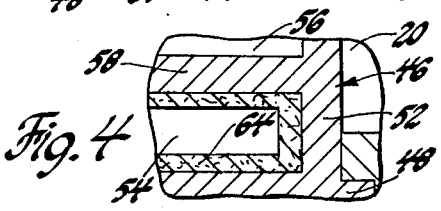
FIG. 4 is an enlarged view of a portion of FIG. 3 illustrating certain details of the heat pipe capsule.

Referring now to the drawing in greater detail, numeral 10 generally indicates an internal combustion engine of the well-known spark ignition type commonly used in automotive vehicles. Engine 10 includes the usual cylinder block 12 defining a plurality of cylinders 14, only one of which is shown. In each of the cylinders there is reciprocably disposed a piston 16 connected by a connecting rod 18 with a conventional crankshaft, not shown. A cylinder head 20 is mounted on the upper end of the cylinder block 12, closing the ends of the cylinders 14 and defining, together with the cylinders and pistons, combustion chambers 22. A combustion gasket 24 is provided to seal the joint between the head and block surfaces.

Each combustion chamber 22 is bordered by surfaces made up of the walls of three different components; namely, the upper wall or crown 26 of the piston, the inner wall 28 of the cylinder and the lower wall 30 of the cylinder head, which may be recessed as at 32 to provide a desirable combustion chamber configuration. The cylinder head is also provided with inlet passages 34 and exhaust passages 35 connecting with the combustion chamber and controlled by inlet and exhaust valves 36, 38, respectively, for admitting air-fuel mixtures to and exhausting gases from the combustion chamber. A threaded opening 40 is also provided, receiving a spark plug 42.

The inlet and exhaust passages and the spark plug opening connect with the recessed portion 32 of the cylinder head, forming the main volume of the combustion chamber. Adjacent the recessed portion is a flat area 44 which is approached closely by the upper wall 26 of the piston and forms therewith a quench zone when the piston is top dead center. In order to maintain cylinder head wall temperature in this zone at a predetermined relatively high value during operation, the cylinder head is provided with a self-contained prefabricated hermetically sealed heat pipe capsule 46 formed according to the present invention.

Capsule 46 is fixed within the lower wall 30 of the cylinder head, preferably by casting it in place. The capsule includes lower, upper and side walls 48, 50, 52, respectively, defining internally a cavity which is divided into evaporator and condenser sections 54, 56, respectively, by an interior wall or baffle 58. The baffle 58 includes a large vapor opening 60 and a plurality of small condensate return openings 62 connecting the two sections. The interior walls of at least the evaporator section 54 are covered with a suitable wick material 64, such as copper wire screen mesh.

The lower wall 48 is directly exposed and defines a portion of the interior surface of the engine combustion chamber 22. It is thus exposed to combustion temperatures. The upper wall 50 has part of its surface exposed to the inlet passage 34 and another part of its surface exposed to and forming part of the surface of a coolant jacket 66 provided in the cylinder head. If desired, and as illustrated, portions of the side walls 52 may also be exposed to the coolant jacket and, in the illustrated embodiment, an externally extending portion of the baffle wall 58 may likewise be exposed to the coolant jacket 66.

The construction of the piston 16 includes a conventional lower section 68 formed of cast aluminum or other suitable material and having attached to the upper portion thereof a prefabricated sealed heat pipe capsule 70, which defines the upper wall and crown portion of the piston. Capsule 70 includes an upper evaporator section 72 which is secured to the lower section of the piston and includes upper, side and lower walls 74, 76, 78 defining internally an evaporator chamber 80. The side wall 76, as well as the walls of the lower portion 68 of the piston, include grooves having piston rings 82. The capsule also includes a lower condenser section 84 having a lower wall 86, and side wall 88 which connects with the upper section to define a condenser chamber 89. Wall 78 extends between these sections forming at this point an intermediate or baffle wall in which are provided a central vapor flow opening 90 and a plurality of smaller condensate return openings 92 around the central opening. The interior of the evaporator chamber 80 is covered with a suitable wick material 94 which also extends through the return opening 92 and down to the lower wall 86 of the condenser chamber 89.

The upper wall 74 of the piston capsule is also the upper wall of the piston and therefore defines a surface of the combustion chamber which is exposed to combustion temperatures. The lower wall 86 of the capsule condenser section is cooled in the illustrated embodiment by a cooling oil spray forced from the end of the connecting rod 18 through an opening 96 which connects with oil passages 97, 98, formed in the connecting rod and connected with a source of piston cooling oil.

Both the cylinder head and piston capsules are provided with predetermined volumes of vaporizable coolant having a high heat capacity. Water and water based solutions such as water alcohol mixtures are known to have particularly high heat capacities suitable for this application, while many other fluid materials would not be suitable. The desirable amount of fluid to be sealed in the capsule is determined by the heat transfer requirements but, in general, it is more than sufficient to saturate all of the wick surfaces within the capsule and less than the volume required to completely fill the evaporator section of the respective capsules when in a liquid state.

The remainder of the volume of each capsule cavity is charged with a predetermined small amount of inert gas, such as nitrogen, to pressurize the capsule to a desired initial pressurization necessary to prevent vaporization of the liquid until a desired lower point of the temperature control range is reached. Satisfactory control further requires that, upon vaporization of the liquid in the evaporator, the increase in pressure will be sufficient only to increase the vaporizing temperature of of the liquid a limited amount, not exceeding the maximum desired control temperature of the capsule.

In operation, when the engine is started or when it is operated at relatively low loads, the combustion temperatures and heat loads are relatively low. In this condition, the heat absorbed by the combustion chamber exposed walls 48 and 74 of the capsules will be utilized for increasing the temperatures of those walls until they reach the temperatures at which the pressurized liquid in their respective capsules begins to vaporize. When this point is reached in each capsule, some of the heat transmitted to the combustion chamber exposed evaporator walls begins to be dissipated by vaporizing the liquid. The vaporized liquid in turn passes through the respective vapor openings 60, 90 to the condenser chambers where it condenses on the cooled walls 50, 86.

In the cylinder head capsule, the condensed liquid drops from wall 50 to the internal baffle wall 58 and drains by gravity through the return opening 62 to the evaporator section 54. In the piston capsule, the condensed liquid is picked up from the condenser wall 86 by the wick material 94 and carried by capillary action through the opening 92 into the evaporator section and along the surface of the upper wall 74, where it is again in position to be vaporized.

Thus, the temperatures of the capsule walls exposed to the combustion chamber are held relatively constant by the boiling-condensing heat transfer action of the capsules under all engine operating conditions. The amount of heat flow varies automatically through increased or decreased vaporization of the heat transfer fluid as required to maintain the wall temperatures within their predetermined ranges.

As illustrated in the drawing, the placement of the heat pipe capsules is such as to provide controlled temperature walls in the combustion chamber areas where quenching of the combustion process is most likely to occur. These include the quench zone opposite the flat wall area 44 of the cylinder head and the crevice volume around the edges of the piston crown. If desired, it would also be possible to include additional capsule units for controlling other portions of the combustion chamber walls such as, for example, the upper areas of the cylinder walls. Control of the wall temperatures in these critical zones promotes complete combustion of air-fuel mixtures adjacent to the walls, while keeping the walls from becoming hot spots that would initiate pre-ignition or detonation or cause coking of fuel residues on the wall surfaces.

The principal advantage of using heat pipe capsules for controlling combustion chamber wall temperatures is their ability to accurately regulate the temperature of a heat absorbing surface. In other applications, accuracies of plus or minus one degree Fahrenheit are common practice. However, in combustion chamber applications, a wider variation of, for example, ten° on either side of the design specification is sufficient for adequate accuracy of regulation.

For durability it is desirable that the heat pipe capsules be fabricated from a noncorrosive, high temperature material such as stainless steel. At the time of manufacture, the capsules are charged with the heat transfer fluid and inert gas and then hermetically sealed so that each unit is completely self-contained and requires no additional processing.

In operation of the heat pipe capsule, the fluid boiling point is controlled by the physical properties of the heat transfer fluid and the pressure of inert gas in the capsule. Vapor produced by boiling flows from the evaporator wall surface to the condenser wall surface which is maintained at a lower temperature by the cooling medium, water, air-fuel mixture or oil spray. At the condenser wall, the vapor condenses and releases its latent heat of vaporization.

Condensate formed at the condenser surface may be returned to the evaporator entirely through gravitational force in some constructions. However, in most cases, a wick is utilized, at least on the walls of the condenser chamber, to pump the condensate back to the evaporator wall surface through the capillary forces provided by the wick. In some constructions the wick will be extended through the condensate return openings and into the condenser chamber to locations where condensate tends to collect. Design consideration may dictate coating the walls of the entire condenser chamber with wick material to promote absorption and pumping of the condensate therein to the evaporator chamber. Any one of a number of possible wick materials could be selected from those known in the art. However, a copper wire screen mesh seems particularly suitable for the present application.

In a representative automotive engine, piston heat loads vary from less than 1 BTU per second at light loads to almost 5 BTU's per second at maximum power. These heat loads must be transferred by the heat pipe capsule from the piston crown to the piston interior surface which is cooled by oil spray. This results in a maximum heat flux on the piston evaporator surface exceeding 600 watts per square inch. To transfer this magnitude of heat flow requires an efficient heat transfer fluid in the heat pipe, such as water or a water based mixture.

The desirable operating temperature of the capsule is partially determined by the influence the piston crown surface temperature has on engine fuel octane sensitivity in the particular engine. However, the control temperature would be established in the range between 280° and 400° F, where water is an acceptable heat pipe fluid. In a cylinder head capsule, if the condenser wall is cooled partially or completely by fuel or air-fuel mixture, it may be desirable to limit the temperature range to between 320° and 360° F where the capsule will provide an effective vaporizing surface without causing fuel coking on the wall. A modification of this feature might be provided in fuel injection engines by arranging fuel nozzles to cause impingement of injected fuel directly on the condenser walls of the heat pipe capsules for vaporization.

It is recognized that in any piston application, the heat pipe capsule fluid will be subjected to high acceleration forces produced by the piston motion. However, by proper design, the wick capillary force can be made higher than the fluid inertia force encountered. Also, since these motions are cyclical, they average out to zero over one revolution of the crankshaft, and thus the wick can function normally to pump the condensate from the condenser to the evaporator. Since normally 90 percent of the fluid in the heat pipe will be trapped in the wick, there will be little effect on heat pipe operation due to free fluid being thrown back and forth by the piston motion.

The use of water as a heat transfer fluid in stainless steel heat pipes has been found to lead to the generation of hydrogen gas. In the temperature range considered here, the rate of generation would be low, but over an extended period sufficient hydrogen gas could accumulate to increase the operating temperature of the heat pipe by 20 or more degrees F. This chemical reaction can be prevented, however, by cladding the interior stainless steel walls with a non-reactive coating such as copper or nickel-cadmium alloy.

While the invention has been disclosed by reference to a particular embodiment chosen for purposes of illustration, it should be understood that numerous variations and modifications of the disclosed embodiment are possible within the inventive concepts disclosed. Accordingly, it is intended that the invention not be limited to the features of the disclosed embodiment, but have the full scope permitted by the language of the following claims.

I claim:

1. A component of an internal combustion engine having a combustion chamber, said component including a portion having first and second heat conducting walls, said first wall bordering a portion of said engine combustion chamber and said second wall bordering a fluid chamber containing in operation a fluid capable of carrying away heat, said component portion defining a sealed cavity between said first and second walls, a third wall dividing said cavity into vaporizing and condensing sections adjacent said first and second walls respectively, said third wall having separate vapor and condensate flow openings therethrough connecting said sections, a charge of vaporizable fluid coolant in said sealed cavity having a volume in the liquid state not greater than the volume of said vaporizing section, and means comprising a predetermined charge of inert gas pressurizing said cavity to establish the vaporizing temperature of said fluid coolant under operating conditions in a predetermined range such that said first wall will reach a temperature high enough to encourage combustion of air-fuel mixtures adjacent thereto in such combustion chamber before substantial vaporization cooling of said first wall begins and such cooling will reach its maximum before said first wall temperature becomes excessively high.

2. The combination of claim 1 wherein said sealed cavity is formed by a prefabricated capsule integrated into said component portion during manufacture thereof.

3. The combination of claim 1 wherein said component is a stationary combustion chamber defining member and said first wall defines a quench area closely approached by a movable combustion chamber defining member.

4. The combination of claim 1 wherein said component is a cylinder head and said first wall defines a quench area closely approached by an associated piston.

5. The combination of claim 1 wherein said component is a piston.

6. A cylinder head for an internal combustion engine, said cylinder head having a first wall adapted to define a portion of an engine combustion chamber, means defining a coolant jacket in said head and adapted to contain a cooling liquid for carrying excess heat away from said first wall, and the improvement comprising a heat transfer control capsule mounted in said first wall, and having walls defining a sealed cavity including adjacent evaporator and condenser chambers separated by a baffle wall, one of said capsule walls comprising an evaporator wall bordering said evaporator chamber and forming a portion of said first cylinder head wall exposed to such combustion chamber to receive heat therefrom, another of said capsule walls comprising a condenser wall bordering on said condenser chamber and forming a portion of said coolant jacket to dissipate heat thereto, said baffle wall having separate vapor and condensate flow openings therethrough connecting said evaporator and condenser chambers and means comprising a charge of vaporizable fluid coolant in said sealed cavity having a predetermined volume in the liquid state less than the volume of said evaporator chamber and a predetermined amount of inert gas pressurizing said cavity to establish a predetermined range of vaporizing temperatures for said vaporizable coolant such that said evaporator wall will reach a predetermined temperature high enough to encourage combustion of air-fuel mixtures adjacent thereto in such combustion chamber before substantial vaporization cooling of said evaporator wall begins and such cooling will reach its maximum before said evaporator wall temperature becomes excessively high.

7. A cylinder head in accordance with claim 6 and further comprising means defining inlet and exhaust passages in said cylinder head and opening through said first wall, said condenser wall being at least partially exposed to said inlet passage to dissipate heat thereto for vaporization of liquid fuel and heating of air-fuel mixture in said inlet passage.

8. A piston for an internal combustion engine, said piston having a top wall adapted to define a portion of an engine combustion chamber, said top wall being formed, at least in part, by a heat transfer control capsule incorporated in said piston and having walls defining a sealed cavity including adjacent evaporator and condenser chambers separated by a baffle wall, one of said capsule walls comprising an evaporator wall bordering said evaporator chamber and forming a portion of said piston top wall exposed to such combustion chamber to receive heat therefrom, another of said capsule walls comprising a condenser wall bordering on said condenser chamber and exposed to the interior of said piston in position for impingement thereon of a cooling fluid to dissipate heat therefrom, said baffle wall having separate vapor and condensate flow openings therethrough connecting said evaporator and condenser chambers, wick means extending through said condensate flow openings for transferring condensate from said condenser chamber to said evaporator chamber, means comprising a charge of vaporizable fluid coolant in said sealed cavity and having a predetermined volume in the liquid state that is less than the volume of said evaporator chamber, and a predetermined amount of inert gas pressurizing said cavity to establish a predetermined range of vaporizing temperatures for said vaporizable coolant such that said evaporator wall will reach a predetermined temperature high enough to encourage combustion of air-fuel mixtures adjacent thereto in such combustion chamber before substantial vaporization cooling of said evaporator wall begins and such cooling will reach its maximum before said evaporator wall temperatures become excessively high.

* * * * *